United States Patent [19]

Smith

[11] 4,076,030

[45] Feb. 28, 1978

[54] METHOD FOR UTILIZING TOBACCO STEMS IN SMOKING PRODUCTS

[75] Inventor: Ezra Thomas Smith, Kernersville, N.C.

[73] Assignee: R. J. Reynolds Tobacco Company, Winston-Salem, N.C.

[21] Appl. No.: 643,207

[22] Filed: Dec. 22, 1975

[51] Int. Cl.[2] ..... A24B 3/18

[52] U.S. Cl. ..... 131/17 R; 131/140 P

[58] Field of Search ..... 131/140 P, 140 C, 140, 131/121

[56] References Cited

U.S. PATENT DOCUMENTS

| | | | |
|---|---|---|---|
| 3,409,022 | 11/1968 | de la Burde | 131/140 P X |
| 3,425,425 | 2/1969 | Hind | 131/140 P |
| 3,524,452 | 8/1970 | Moser et al. | 131/140 P |
| 3,556,112 | 1/1971 | de la Burde et al. | 131/140 P |
| 3,734,104 | 5/1973 | Buchanan et al. | 131/140 P |

*Primary Examiner*—Robert W. Michell
*Assistant Examiner*—V. Millin
*Attorney, Agent, or Firm*—Herbert J. Bluhm

[57] ABSTRACT

Tobacco stems are adjusted to a moisture content of at least 18 percent before subjecting them to a cutting operation of at least 25 cuts per inch. The cut stems are then expanded before subjecting them to a second cutting operation which produces particle sizes of desired dimensions.

9 Claims, No Drawings

METHOD FOR UTILIZING TOBACCO STEMS IN SMOKING PRODUCTS

BACKGROUND OF THE INVENTION

The use of tobacco stems in the manufacture of smoking products has long been recognized as a desirable objective in view of the obvious economic benefits to be derived therefrom. The physical shape and properties of the stems, however, make it necessary to convert the stems into a form that will be compatible with the intended use. One approach that has been used is described in U.S. Pat. No. 3,556,112 wherein tobacco stems are first puffed and then sliced in a plane substantially parallel to the stem axes. This approach has inherent disadvantages including limited and non-uniform puffing of the intact stem as well as difficulty in aligning the puffed stems with respect to the cutting blade which must be of special design to prevent collapse of the puffed stems. Another approach is disclosed in U.S. Pat. No. 3,734,104 which involves rolling or crushing tobacco stems prior to cutting the flattened stems to filler size. The rolled, cut stems are then expanded in a hot, gaseous medium containing at least 30 percent by volume of steam. This latter approach also has attendant disadvantages in that the final dimensions of the expanded stem material tend to be quite variable because the rolling or crushing operation affects the degree of expansion that can be subsequently obtained. It is noted that this latter patent teaches cutting the crushed stems at 75 to 200 cuts per inch which produces particle sizes significantly smaller than conventional cut filler which is produced by cutting strip tobacco at approximately 30 cuts per inch. Thus, it is apparent that the success in producing cut, expanded stems of uniform filler size using this latter method depends on uniform expansion of cut stem material that is less than cut filler size. Inasmuch as the integrity of the cell structure within the stems is affected by the rolling or crushing operation, it is virtually impossible to obtain uniform filler dimensions by the use of such a process.

SUMMARY OF THE INVENTION

The present invention provides an improved method whereby increased expansion of tobacco stem material can be obtained while at the same time the expanded, cut stems have a uniform particle size approximating that of either cut cigarette filler or cut pipe tobacco. This result is achieved by cutting moist tobacco stems to at least 40 cuts per inch, expanding the cut stems under suitable conditions for expansion and subjecting the expanded, cut stems to a second cutting operation to produce particle sizes comparable to those found in cut tobacco filler for cigarettes or cut pipe tobacco. Tobacco stems processed in accordance with this invention are eminently suited for use in the manufacture of smoking products.

DETAILED DESCRIPTION OF THE INVENTION

This invention may be applied to either burley or flue-cured stems (washed or unwashed) and it is preferred that the stems be 3 to 4 inches in length. The moisture content of the stems is first adjusted to a level between approximately 18 and 50 percent (dry basis) and preferably between 25 and 35 percent by treating the stems with water, steam or a combination thereof. Depending on the moistening treatment used, it may be necessary to allow the treated stems to bulk for a short period of time, perhaps 30 minutes to 1 hour, so that a more uniform moisture level throughout the mass of stems will be obtained. Moistening of the stems is important in order to minimize shattering of the stem pieces during the subsequent cutting operation.

The moistened stems are next subjected to a cutting operation in which the cuts per inch applied to the stems are between about 25 and 150, more preferably between 40 and 125 and most preferably between 50 and 100. Although the angle of the cut is not critical, it is preferred that the longitudinal axes of the stems be aligned more or less perpendicularly to the plane of the cutting blade. This orientation of the stems produces cross sections or transverse slices which are capable of expanding to a much greater degree than are longitudinal slices. Cutters which have been found to give satisfactory results for the purposes of this invention include a Rotary Type Tobacco Cutter produced by Molins Limited of London, England, a High-Speed Rotary Tobacco Cutter available from Himoff Machine Company of Long Island City, New York and the Mark III Millicutter which is manufactured by Robert Legg Limited of London, England.

A certain amount of fines may be produced incident to the cutting operation. If desired, these fines may be conveniently removed by subjecting the cut stems to a sieving or sifting operation. Generally speaking it has been found that cut stems retained on a No. 12 or No. 14 sieve (U.S. Standard Series) are suitable for further processing in accordance with the present invention.

Puffing of the cut stems may be effected by various means known to the art. For example, the stems may be rapidly heated in a hot gas stream, exposed to radiant energy or subjected to vacuum conditions. It may be necessary to readjust the moisture level of the cut stems prior to puffing depending on the puffing conditions used. It is particularly preferred to puff the cut stems by the use of a volatile organic compound as described in U.S. Pat. Nos. 3,524,451, 3,524,452 and 3,693,631. When volatile organic compounds are used as the puffing agents, the initial moisture content of the cut stems is preferably in the range of 18 to 40 percent (dry basis).

The effectiveness of volatile organic compounds as puffing agents is demonstrated by the data shown in Table 1. The puffing conditions used were essentially the same for all samples with trichloromonofluoromethane as the puffing agent. The filling capacity of each sample was determined after the sample was allowed to equilibrate for 6 days in a constant 60% relative humidity chamber. The filling capacity measurement was made by placing a 100-gram sample of stem material in a graduated cylinder provided with a piston having sufficient mass to apply a pressure of 2.30 pounds per square inch to the sample. Volume of the sample in milliliters was read after the indicated pressure had been applied for 2 minutes.

TABLE 1

| Stem Material | Cuts Per Inch | Percent Moisture of Cut Stems Before Puffing | Filling Capacity of Cut Stems in ml./100 g. |
|---|---|---|---|
| Washed Burley | 120 | Not puffed | 561 |
| Washed Burley Stems | 120 | 33.0 | 1154 |
| Unwashed Burley Stems | 120 | 39.0 | 1034 |
| Washed Burley Stems | 60 | 30.1 | 1171 |
| Unwashed Burley Stems | 60 | 33.6 | 1084 |

TABLE 1-continued

| Stem Material | Cuts Per Inch | Percent Moisture of Cut Stems Before Puffing | Filling Capacity of Cut Stems in ml./100 g. |
|---|---|---|---|
| Unwashed Flue-Cured Stems | 63 | 39.0 | 1108 |

Since puffing may result in a small amount of fines being produced, the puffed cut stems may be sieved or screened if desired to remove such fines. Puffed cut stems which are retained on a No. 8 or No. 10 sieve are preferred for cutting in the subsequent step to produce particle sizes that are compatible with the end use contemplated.

The data in Table 1 show that filling capacity increases of 100 percent or more can be obtained when the cut stems are puffed. Since the puffed cut stems have a greatly increased volume and surface area, they are next subjected to a second cutting operation to give particles of desired dimensions. Quite surprisingly, it has been found that this second cutting step does not result in a substantial reduction in filling capacity for the stem material. Thus, washed burley stems which were cut at 60 cuts per inch, sieved to give particles greater than 8 mesh and then puffed were determined to have a filling capacity of 1108 ml./100 g. The puffed cut stems were then cut at 32 cuts per inch to give stem material with a filling capacity of 1073 ml./100 g. It is preferred that the moisture content of the puffed cut stems be in the range of approximately 10 to 20 percent at the time of the second cutting operation to minimize production of fines and to prevent undue shrinkage caused by drying of excessively moist particles.

When the treated stems are to be used in the manufacture of cigarettes, the second cutting operation is selected to give dimensions of cut filler that is normally used in cigarettes. Cut filler for cigarettes is usually prepared by cutting tobacco strips at about 25 to 40 cuts per inch. Alternatively, the puffed cut stems may be cut to dimensions that are conventionally used in the manufacture of pipe tobacco. Smoking products containing up to 100 percent of the puffed cut stems may be prepared although it is understood that such stem material may also be treated with flavor additives, humectants, combustion modifiers, etc. to render products prepared therefrom more acceptable as far as the smoking properties are concerned.

In a preferred embodiment puffed cut stems are blended with tobacco strips in proportions of up to about 60 percent by weight prior to cutting at approximately 32 cuts per inch. Blending with strip tobacco eliminates the need for a separate cutting operation for the stem material and simplifies the actual cutting step. The resulting blend of cut tobacco is very suitable for use in the manufacture of cigarettes in that the presence of the puffed stem material, even in small proportions, reduces the quantity of tobacco required per cigarette. Thus, the relatively low density of the puffed stem material replaces a portion of the cut strip tobacco which has a higher density thereby resulting in cigarettes having reduced weight when compared with a control. This is demonstrated by the data in Table 2 wherein puffed cut burley stems were conventionally processed and made into cigarettes by blending with a commercial blend of tobacco strips in varying proportions. The combined puffed cut stems and tobacco strips were cut at 32 cuts per inch.

TABLE 2

| Weight Percent Tobacco Strips | Weight Percent Burley Stems | Weight of Tobacco Rod in Grams |
|---|---|---|
| 100.0 | 0 | 1.066 |
| 92.8 | 7.2 | 1.034 |
| 80.0 | 20.0 | 0.994 |
| 60.0 | 40.0 | 0.942 |
| 40.0 | 60.0 | 0.784 |

The following examples further illustrate the present invention and the advantages associated with it.

EXAMPLE 1

Unwashed burley stems were conditioned to 33.6% moisture by treating the stems with steam and water before bulking the moistened stems for 1 hour. The conditioned stems were then cut at 60 cuts per inch using a Molins rotary type cutter. The cut stems were puffed using the process described in U.S. Pat. No. 3,693,631 with trichloromonofluoromethane as the organic puffing agent. Puffing temperatures employed were between 240° and 275° F. The puffed cut stems were blended with a commercial blend of tobacco strips at the rate of 3.75% by weight puffed stem material in the total blend. This blend of strips and puffed cut stems was then processed in conventional manner including shredding of the blend at about 30 cuts per inch. Cigarettes were prepared from this blend and compared with control cigarettes with the following results:

| Measurement | Control Cigarette | Test Cigarette |
|---|---|---|
| Weight in grams (tobacco rod only) | 0.869 | 0.848 |
| Circumference of tobacco rod, mm. | 24.98 | 25.05 |
| Draft in inches of water | 3.97 | 4.10 |
| Nicotine in mg/cigarette | 1.27 | 1.17 |
| FTC Tar in mg/cigarette | 19.7 | 18.7 |

The cigarettes were also evaluated by a panel of expert smokers with the test cigarette being preferred by a majority of the smokers.

EXAMPLE 2

Washed burley stems were adjusted to 30.1% moisture and allowed to equilibrate overnight. The moistened stems were cut at 120 cuts per inch using a Molins rotary type cutter. The cut stems were puffed and further processed into cigarettes as described in Example 1 except that the puffed stems were used at the rate of 3.0% by weight in the total blend. Results were as follows:

| Measurement | Control Cigarette | Test Cigarette |
|---|---|---|
| Weight in grams (tobacco rod only) | 0.894 | 0.876 |
| Circumference of tobacco rod, mm. | 24.99 | 24.95 |
| Draft in inches of water | 3.83 | 4.09 |
| Nicotine in mg/cigarette | 1.37 | 1.26 |
| FTC Tar in mg/cigarette | 20.0 | 19.3 |

The cigarettes were evaluated by a panel of expert smokers with the test cigarettes being preferred by a significant number of the smokers.

EXAMPLE 3

Flue cured tobacco stems were adjusted to 39.0% moisture and allowed to equilibrate overnight. The moistened stems were cut at 63 cuts per inch using a Legg Mark III Millicutter, sieved to remove particles smaller than 8 mesh and puffed according to the procedure mentioned in Example 1. The puffed cut stems were added to a commercial blend of tobacco strip at a level of 5 percent by weight based on the total blend. Cutting of this blend at 32 cuts per inch and about 18 percent moisture was carried out using a model B-35 Himoff cutter. The resulting cut filler was reordered to about 12.5 percent moisture and made into cigarettes. For cigarettes of comparable firmness the weight of the tobacco rod made from the test blend (i.e., containing 5% puffed stem material) was 0.915 gram as compared with 0.969 gram for a control cigarette containing only the tobacco strips. A panel of expert smokers compared the two cigarettes and detected no significant difference in the smoking qualities thereof.

EXAMPLE 4

The procedure of Example 3 was repeated except that both flue-cured stems as well as washed burley stems were cut at 120 cuts per inch at a moisture level of about 31% after bulking for one hour. The puffed cut stems were combined with a commercial blend of tobacco strips using the following proportions:

| | |
|---|---|
| Tobacco Strips | 83.37% by weight |
| Puffed cut burley stems | 6.56% by weight |
| Puffed cut flue-cured stems | 10.07% by weight |

Cigarettes prepared from the test blend weighed 0.799 gram as compared with 0.915 gram for a control cigarette containing tobacco strips only even though both cigarettes exhibited the same degree of firmness. A panel of expert smokers was unable to distinguish the test cigarette from the control cigarette.

What is claimed is:

1. The process of treating tobacco stems that have not been previously rolled or crushed which comprises conditioning the stems to a moisture content between 18 and 50 percent, subjecting the conditioned stems to a cutting operation in which the cuts per inch are at least 25, expanding the cut stems and subjecting the expanded cut stems to a second cutting operation to produce particle sizes approximating those found in cut tobacco filler for cigarettes or cut pipe tobacco.

2. The process of claim 1 in which said cuts per inch are between 40 and 125.

3. The process of claim 1 in which the cut stems are expanded by using a volatile organic compound as the puffing agent.

4. The process of claim 1 in which the expanded cut stems are blended with tobacco strips prior to the second cutting operation.

5. The process of claim 4 in which the second cutting operation is effected at about 25 to 40 cuts per inch.

6. A filler for cigarettes which contains tobacco stems that have been previously processed through a sequence of steps comprising:

a. conditioning stems that have not been previously rolled or crushed to a moisture content between 18 and 50 percent;
b. cutting the conditioned stems at 25 to 150 cuts per inch;
c. expanding the cut conditioned stems; and
d. subjecting the expanded cut stems to a second cutting operation in which the cuts per inch are between 25 and 40.

7. A filler according to claim 6 in which said conditioned stems are cut at 40 to 125 cuts per inch.

8. A filler according to claim 6 in which the cut conditioned stems are expanded by using a volatile organic compound as the puffing agent.

9. A filler according to claim 6 in which the expanded cut stems are blended with tobacco strips prior to the second cutting operation.

* * * * *